United States Patent [19]

Van Noord

[11] Patent Number: 4,632,393

[45] Date of Patent: Dec. 30, 1986

[54] MULTI-PURPOSE EXERCISING APPARATUS

[76] Inventor: Andrew J. Van Noord, 1434 Hillsboro, SE., Grand Rapids, Mich. 49506

[21] Appl. No.: 688,706

[22] Filed: Jan. 4, 1985

[51] Int. Cl.[4] ..... A63B 21/00

[52] U.S. Cl. ..... 272/134; 272/131; 272/72

[58] Field of Search ..... 272/72, 125, 126, 130, 272/131, 132, 133, 134, 135, 136; 128/25 R

[56] References Cited

U.S. PATENT DOCUMENTS

| | | | |
|---|---|---|---|
| 1,707,791 | 4/1929 | Anderson | 272/72 |
| 1,866,860 | 7/1932 | Pareira | 272/72 |
| 1,975,021 | 9/1934 | Schmidt | 272/72 |
| 2,621,043 | 12/1952 | Olmstead . | |
| 2,680,967 | 6/1954 | Newman . | |
| 2,714,507 | 8/1955 | Goodrich | 272/72 |
| 2,780,367 | 5/1955 | Lusk . | |
| 2,832,334 | 4/1958 | Whitelaw | 272/132 |
| 3,174,343 | 3/1965 | Kasolis | 272/130 X |
| 3,190,648 | 6/1965 | Kallenbach . | |
| 3,298,688 | 1/1967 | Grzybowski . | |
| 3,323,366 | 6/1967 | DeLorme et al. | 272/125 X |
| 3,466,931 | 9/1969 | Spackman, Jr. et al. . | |
| 3,589,720 | 6/1971 | Agamian | 272/131 |
| 3,971,255 | 7/1976 | Varney et al. | 272/131 X |
| 4,208,049 | 6/1980 | Wilson | 272/138 |
| 4,249,725 | 2/1981 | Mattox . | |
| 4,384,715 | 5/1983 | Savio et al. . | |
| 4,408,759 | 10/1983 | Reweau et al. | 272/131 |
| 4,428,578 | 1/1984 | Kirkpatrick | 272/136 |
| 4,487,199 | 12/1984 | Saringer | 128/25 R |

FOREIGN PATENT DOCUMENTS

| | | | |
|---|---|---|---|
| 2810632 | 9/1979 | Fed. Rep. of Germany | 272/134 |
| 2031285 | 4/1980 | United Kingdom . | |

*Primary Examiner*—Richard J. Apley
*Assistant Examiner*—Robert W. Bahr
*Attorney, Agent, or Firm*—Varnum, Riddering, Schmidt & Howlett

[57] ABSTRACT

A multi-purpose exercising apparatus (100) is adapted for use by a patient (224) to exercise selected muscle/skeletal groups in the back, abdomen and other regions. The apparatus (100) includes a rectangular base (102) having a cushion (104) mounted thereon. A pair of upwardly angled tubular bars (108) are connected to the rectangular base (102) and pivotably mount an exercise bar mechanism (124) having an elongated outer tube (126) with a power slide (132) having a friction mounting on the tube (126). The bar mechanism (124) is coupled to a handle (150) releasably securing a back supporting strap (162). In one particular structural use, a patient (224) secures himself or herself within the back supporting strap (162) and exerts horizontal pushing or pulling forces on the bar mechanism (124) so as to move the elongated outer tube (126) relative to the power slide (132). In other uses, the patient (224) can maintain an upright or a supine position, and exert forces on the bar mechanism (124) with the bar mechanism at various angles relative to the tubular bars (108) so as to exercise muscles in the shoulders, back, abdomen and arms. A force measuring mechanism (170) is coupled between the tube (126) and handle rod (156) so as to measure external forces exerted by the patient (224) against the handle rod (156).

17 Claims, 8 Drawing Figures

MULTI-PURPOSE EXERCISING APPARATUS

DESCRIPTION

1. Technical Field

The invention relates to exercising apparatus and, more particularly, to portable apparatus for exercising selected muscle/skeletal groups, including those in the back, abdomen, hip, leg, shoulder and arm regions, and for measuring the relative magnitudes of forces exerted during exercise.

2. Background Art

Various types of exercise equipment have been developed throughout history. This equipment is often directed to the exercising and strengthening of various muscle groups, such as the commonly known hand-held squeezing devices for exercising muscles of the hands and lower arms. However, more complex devices have been designed for use in strengthening and exercising other selected muscle groups. Historically, many of these devices used weights, springs or other pre-set resistances to movement. Such devices required the user to use only that amount of strength necessary to move the device through a weakest part of any movement.

Recently, other devices have been developed which offer resistance at a level adapting automatically to the user's abilities and providing resistance at a level the same or nearly the same as the force applied throughout the entire range of an exercise stroke. Such equipment is typically referred to as "isokinetic" exercising equipment. Many isokinetic exercise devices are relatively complex, expensive and require frequent maintenance. In addition, many of these devices are relatively large and typically require positioning at a stationary fixed location.

Examples of isokinetic exercising equipment are disclosed in a Mattox U.S. Pat. Nos. 4,249,725 issued Feb. 10, 1981, and 4,385,760 issued May 31, 1983. More recently, a new isokinetic exercise device has the form of a cane which is relatively portable and capable of movement from location to location. This device is particularly advantageous for handicapped individuals.

Although the cane provides substantial advantages over other known exercising equipment, the number and variety of different exercises that can be performed for muscle/skeletal groups in a particular body region is somewhat limited. For example, the variety of exercises available for muscle/skeletal groups in the back and abdomen regions are limited when the exercising apparatus does not include any particular supporting structure for exerting forces against the structure by using the back and abdomen muscle groups.

In addition, it is also advantageous if the exercising apparatus is not only directed to exercise of the abdomen and back muscle groups, but also includes devices to measure forces exerted by the user during exercise. One type of exercising device employing a force measuring mechanism is disclosed in the Varney et al U.S. Pat. No. 3,971,255 issued July 27, 1976. The Varney et al patent discloses an exercise bar having a sleeve mounted to an elongated tube and slidable with respect to the tube. Bushings within the tube provide a friction slide between the sleeve and the tube, and handles are provided on the sleeve and at one end of the tube. Resistance of the sleeve on the tube is provided through a flat-headed pin and an adjustable tension spring which exerts forces on the pin. A force measuring device is provided by a coil spring which is positioned between the outer end of the sleeve and an internal bushing. A gauge is mounted on the sleeve and indicates the amount of force applied by the user.

SUMMARY OF THE INVENTION

In accordance with the invention, a multi-purpose exercise apparatus includes a portable structural frame to provide a fixed base support while the apparatus is in use. The frame includes body-positioning means to position one portion of the user's body. An exercise bar assembly includes a sleeve member, an elongated tube slidably received through the sleeve member, and means to provide frictional resistance to movement of the tube through the sleeve member. Means are also provided to mount the bar assembly to the structural frame. Force measuring means are mounted to the tube to visually indicate the relative magnitude of force applied between the sleeve member and the tube. In addition, force applying means are mounted to the bar assembly and adapted to be selectively positioned relative to the user so as to bear against the user's upper frontal region, back or upper legs, or to be releasably gripped by the user's hands so as to exert axially-directed forces on the tube relative to the sleeve member in response to forces exerted by the user.

The force applying means includes releasably secured strap means so that the user, while maintaining a sitting position on the body-positioning means, can move the tube through the sleeve member by exerting forces against the strap means through his or her back. In addition, the force applying means also includes a flat surface adjacent one end of the tube and located in a plane perpendicular to the tube. The user, while maintaining a seated upright position on the body-positioning means, can move the tube through the sleeve member by pushing against the flat surface with his or her sternum region. Furthermore, while the user maintains a supine position on the body-positioning means, the strap means can be secured around the user's leg regions adjacent to the knee regions, so that the user can move the tube through the sleeve member by exerting forces against the force applying means with the user's upper legs.

The mounting means includes a pair of elongated bars rigidly secured to the structural frame. The bars extend upwardly and forwardly from the frame at an angle thereto. Pivot means are coupled to the bars and the sleeve member to pivotably mount the sleeve member relative to the structural frame. The pivot means allows the bar assembly to be positioned in a vertical orientation, and the user can exert forces on the bar assembly through the force applying means so as to move the elongated tube through the sleeve in a manner so as to exercise muscle groups in the shoulder regions. Furthermore, the pivot means allows the bar assembly to be angled relative to the frame so that the user can releasably grip the force applying means and move the elongated tube through the sleeve member in a manner so as to exercise bicep and tricep muscles in the arm regions.

The body-positioning means includes a cushion on which the user may sit. The force applying means is coupled to one end of the elongated tube, and the force measuring means can be mounted on the tube adjacent the one end.

The force measuring means includes a dial face mounted on the tube and visible to the user. A pointer is rotatably mounted on the dial face and visually indicates forces applied to the tube relative to the sleeve member.

The exercise apparatus also includes means to adjustably limit the movement of the tube through the sleeve member. The movement limiting means includes a pair of rings slidably mounted on the tube. One of the rings is positioned on each side of the sleeve member. In addition, means are coupled to each of the rings to secure the rings in an adjusted position on the tube. The tube can be limited to movement along the entire length of the tube down to no movement at selected positions along the tube length.

The force applying means can also include a hand-bar perpendicularly coupled to one end of the tube. A rectangular support block is mounted to the hand-bar so as to be perpendicular to an axis of the tube. In addition, a strap is releasably coupled to the hand-bar ends.

BRIEF DESCRIPTION OF DRAWINGS

The invention will now be described with reference to the drawings in which.

DETAILED DESCRIPTION

The principles of the invention are disclosed, by way of example, in a multi-purpose exercising apparatus 100 as depicted in FIGS. 1–4. The exercising apparatus 100 is adapted for use by individuals as a stand-alone unit to exercise various muscle/skeletal groups, including those in the shoulder, abdomen, hip, leg, back and arm regions. The apparatus 100 is relatively simple in design, lightweight and portable, thereby particularly advantageous for use by handicapped individuals or other patients undergoing rehabilitative exercise therapy. As will be described in detail herein, the apparatus 100 is adapted to provide resistance to movement during an exercise stroke, thereby requiring strengthening forces to be exerted by the patient. In addition, the exercising apparatus 100 includes force measuring means to provide a visual indication of the forces exerted by the user during exercise.

Figure 1:
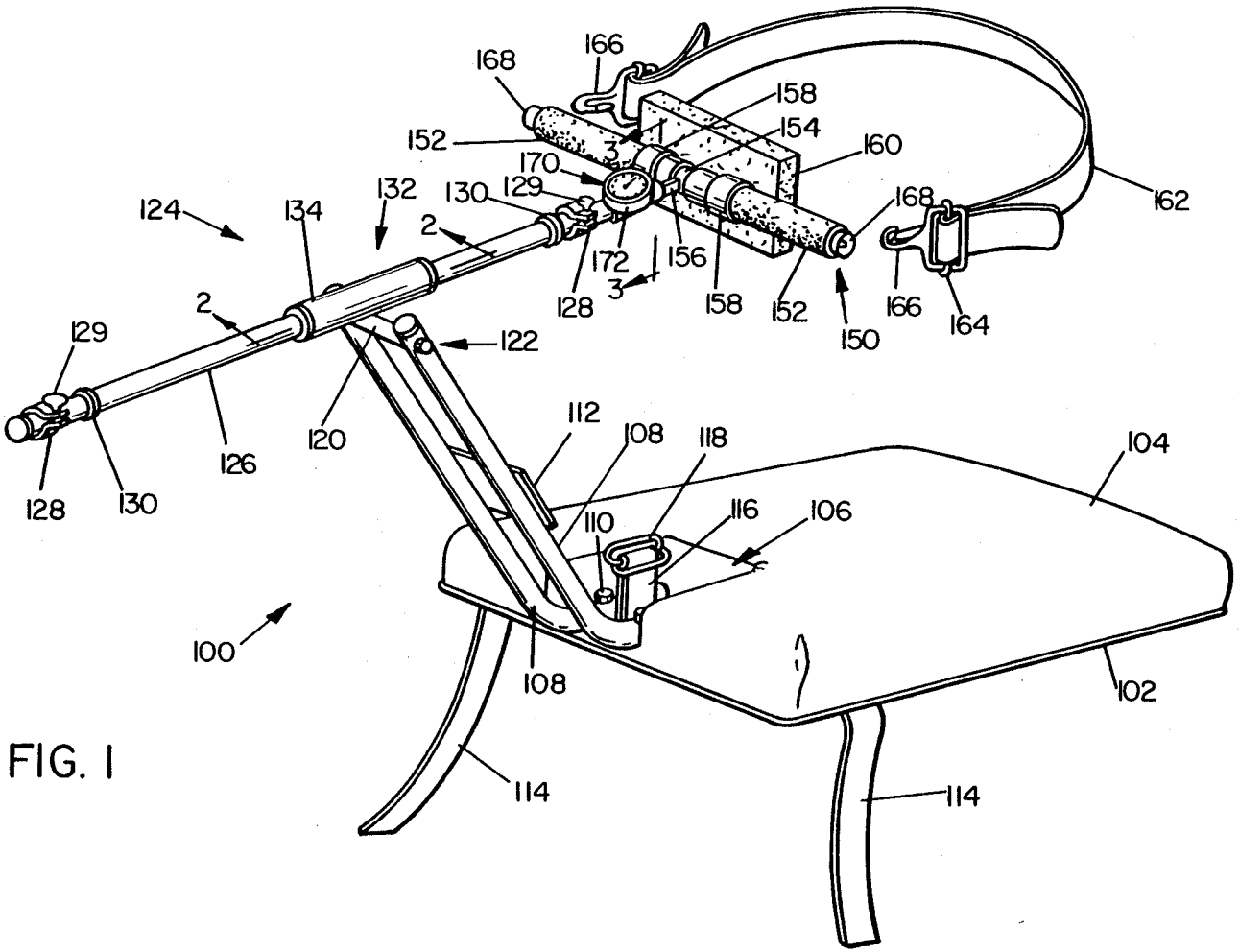
FIG. 1 is a perspective view of a multi-purpose exercising apparatus in accordance with the invention.

Referring to FIG. 1, the multi-purpose exercising apparatus 100 includes a rectangular base 102 having an area sufficient to support the user patient's body during the exercise. Mounted to the rectangular base 102 in any suitable and conventional manner is a cushion 104 to provide comfort to the user patient during exercise. Ordinarily, the base 102 will be positioned on a table or like surface so that the user legs can extend downwardly of the base 102.

The cushion 104 includes a recessed area 106 at one end thereof. Within the recessed area 106, a pair of tubular bars 108 are rigidly mounted to an upper surface of the rectangular base 102 by any suitable connecting means, such as the nut and bolt assemblies 110. The tubular bars 108 extend outwardly and upwardly from the rectangular base as shown in FIG. 1, with reinforcing means such as the reinforcing plate 112 interconnecting the bars 108 so as to provide suitable rigidity and strength.

To secure the patient's legs on the cushion 104 during exercise, the multi-purpose exercising apparatus 100 includes a pair of leg straps 114 mounted to the lower portion of rectangular base 102 at opposing sides thereof. A common strap 116 is secured by any suitable connecting means to the rectangular base 102 within the recessed area 106, and includes a buckle 118 for purposes of selectively strapping and securing either or both of the patient's legs by means of the leg straps 114 during exercise.

At the upper end of the tubular bars 108, a cross bar 120 is pivotably coupled to each of the bars 108 by means of conventional pivot connections 122 (only one of which is shown in FIG. 1). Rigidly mounted to the cross bar 120 is an exercise bar mechanism 124. The bar mechanism 124 includes an elongated outer tube 126 preferably constructed of a lightweight but durable material. Mounted to the outer tube 126 are a pair of adjustable control rings 128. Each ring 128 includes a thumb screw 129 threaded therein to allow the user to secure the rings 128 at selected positions along the radial outer surface of the outer tube 126. A pair of lubrication rings 130 are mounted on outer tube 126 inwardly of the control rings 128. The lubrication rings 130 can be made of leather or similar material, and impregnated with a lubricant.

Positioned between the adjustable control rings 128 and received on the outer tube 126 is a power slide 132 comprising a sleeve 134 secured by any suitable connecting means to the cross bar 120. A friction mounting can be provided between the sleeve 134 and the elongated tube 126, so that the tube 126 is slidable relative to the sleeve 134, but with some degree of force required to generate the sliding movement. The friction mounting can also provide a substantially higher frictional resistance to movement of the tube 126 in one direction relative to the axial length of sleeve 134 than in the opposite direction of relative movement. Ordinarily, a friction mounting arrangement works in an isotropic manner. In addition, the friction mounting can provide for a frictional resistance directly proportional to the linear forces exerted by the patient and applied to the elongated tube 126 relative to the sleeve 134.

Figure 2:
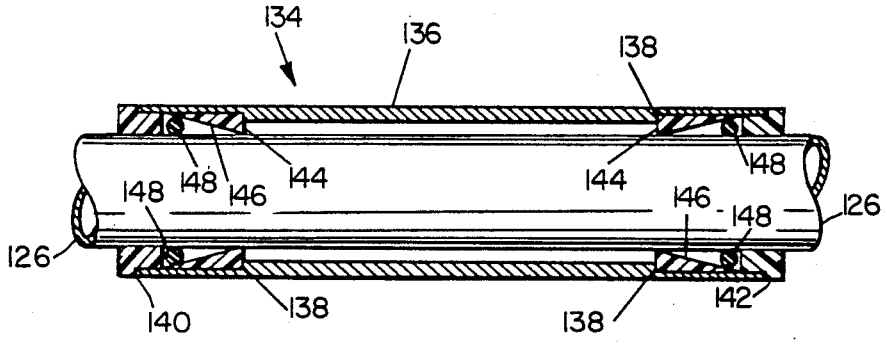
FIG. 2 is a sectional view of the exercise bar mechanism of the multi-purpose exercising apparatus showing an exemplary friction mounting of the power slide to the elongated tube and taken along lines 2—2 of FIG. 1.

An exemplary friction mounting arrangement comprising several of these features and suitable for use in the multi-purpose apparatus 100 is depicted in FIG. 2. Referring thereto, the sleeve 134 comprises a tubular member 136 which is concentric with the axis of the outer tube 126. The inner diameter of the tubular member 136 is larger than the outer diameter of the tube 126 so that an annular space is provided therebetween. Annular shoulders 138 are found in the inner surface of the tubular member 136. The tubular member 136 is supported on the elongated tube 126 by a pair of annular frictionless bushings 140 and 142. The bushings 140 and 142 are maintained on the tubular member 136 through any suitable connecting means, such as a pair of set screws, staking or adhesive connections.

A pair of brake mechanisms 144 are mounted within the tubular member 136, adjacent to the frictionless bushings 140 and 142 and in abutting relationship with the corresponding annular shoulders 138. The brake mechanisms 144 each comprise an elongated annular bushing, preferably made of plastic and having an internal ramped or conical surface 146. A pair of rubber O-rings 148 are slidably mounted on the outer tube 126, each fitting within an end of a corresponding brake mechanism 144. The inner diameter of each O-ring 148 is only slightly smaller than the outer diameter of the outer tube 126 so that there is some frictional resistance between each O-ring 148 and the outer tube 126. Any suitable rubber or synthetic O-ring can be used.

In operation, as the outer tube 126 is moved to the left as viewed in FIG. 2, the frictional resistance between the O-ring 148 on the right and the elongated tube 126 causes the right-side O-ring 148 to ride up on the corresponding and adjacent ramp 146, thereby increasing the frictional resistance between the right-side O-ring 148 and the outer tube 126. The extent of movement of the right-side O-ring 148 and the extent of frictional forces between the O-ring 148 and the outer tube 126 depend on the forces applied by the user to the elongated outer tube 126. In other words, the harder the forces, the greater the frictional resistance of the sleeve 134. Thus, the sleeve 134 provides a varying kinematic resistance to movement of the outer tube 126, the amount of frictional resistance being dependent on the amount of force applied to the outer tube 126 with respect to the sleeve 134.

During movement of elongated outer tube 126 to the left as viewed in FIG. 2, the left-side O-ring 148 will move into abutting relationship with the corresponding bushing 140. In this position of the left-side O-ring 148 with respect to the surface 146 of corresponding brake mechanism 144, little or no frictional resistance is applied by the left-side O-ring 148 on the elongated tube 126. However, movement of the elongated outer tube 126 to the right as viewed in FIG. 2 will cause the left-side O-ring 148 to ride up on the ramp surface 146 of the corresponding left-side brake mechanism 144. In the same manner as previously described for movement of elongated outer tube 126 to the left, the amount of frictional resistance between sleeve 134 and tube 126 will be dependent on the amount of force applied to the outer tube 126 with respect to the sleeve 134.

It should be emphasized that various other types of friction mounting arrangements can be employed with the multi-purpose exercising apparatus 100. The aforedescribed particular means for mounting the power slide 132 comprising sleeve 134 to the elongated outer tube 126 does not form the basis for the principal concepts of the invention described and claimed herein.

Referring again to FIG. 1, positioned at one end of the exercise bar mechanism 124 is a handle 150 comprising a pair of hand grips 152 constructed of a rubber covering or other suitable means to provide a firm gripping surface. The hand grips 152 are received on opposing ends of an elongated bar 154. Rigidly secured to the central portion of the elongated bar 154 in any suitable manner is a handle rod 156 which is slidably received within one end of the elongated outer tube 126 and interconnected thereto in a manner subsequently described herein.

Rigidly secured to the handle 150 by means of clamps 158 is a support block 160 as shown in FIG. 1. As described subsequently herein, support block 160 provides a means for the user patient to exert pushing forces on the exercise bar mechanism 124 in a manner so as to provide suitable exercises for muscle/skeletal groups in the back and abdomen regions.

The multi-purpose exercising apparatus 100 also includes an adjustable back supporting strap 162 having a buckle 164 for purposes of adjusting the length of strap 162. Coupled to the ends of the supporting strap 162 are a pair of conventional and releasable hook locks 166. The hook locks 166 are securable to holes 168 in the ends of the elongated bar 154. The back supporting strap 162 and associated hook locks 166 and holes 168 provide a back supporting means for the user patient during exercise and, in addition, provide a means for the user patient to exert pulling forces on the elongated tube 126 relative to the sleeve 134 during exercise. In addition, as subsequently described herein, the supporting strap 162 can be used around the knee region during an exercise wherein the user is in a supine position.

Figure 3:
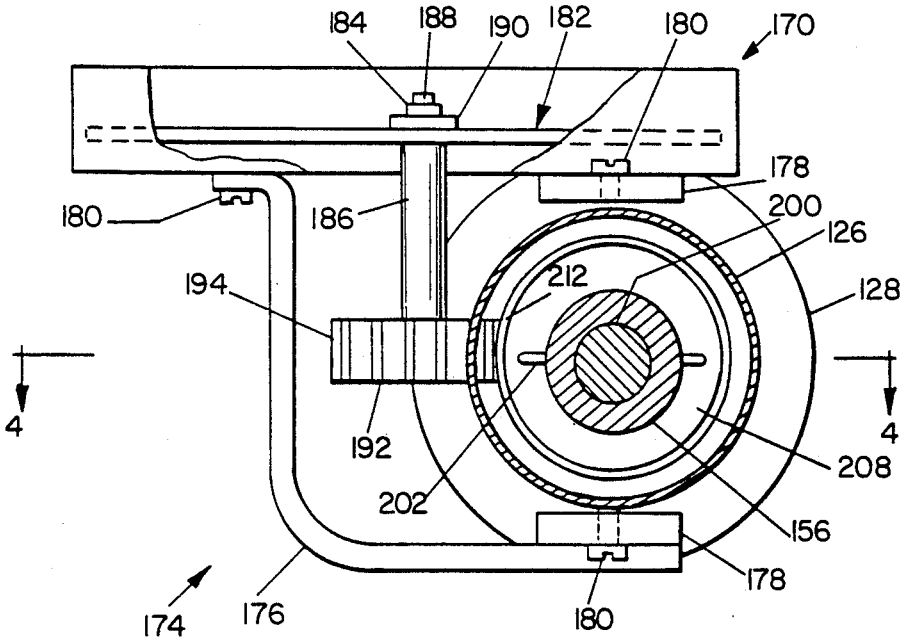
FIG. 3 is a sectional view of the multi-purpose exercising apparatus showing components of the force measuring mechanism and taken along lines 3—3 of FIG. 1.

Mounted to the elongated tube 126 adjacent the interconnection of exercise bar mechanism 124 to the handle 150 is a force measuring mechanism 170 as depicted in FIG. 1. Referring to FIG. 1 and particularly FIGS. 3 and 4, the force measuring mechanism 170 includes a circular gauge housing 172 rigidly mounted to the outer tube 126 by means of a gauge bracket mounting 174. As shown in FIG. 3, the bracket mounting 174 includes an angled bracket 176 secured to the bottom of gauge housing 172 and one of two straight brackets 178 through screws 180. At the upper portion of the outer tube 126, the housing 172 is directly mounted to the outer tube 126 by means of screws 180 connected through a second straight bracket 178.

Mounted within the housing 172 and maintained stationary relative thereto is a dial face 182 having spaced apart markings to provide a visual indication of the force exerted by the patient during use of the exercise apparatus 100. Rotatably mounted immediately above the dial face 182 is a dial pointer 184. The dial pointer 184 is secured to a gear shaft 186 by means of a screw 188 and stationary washer plate 190. The mounting of the dial pointer 184 above the dial face 182, and the mounting of gear shaft 186 through dial gauge housing 172 and dial face 182, allows the shaft 186 to rotate relative to the dial face 182, thereby correspondingly rotating dial pointer 184 to indicate magnitudes of forces exerted by the user patient.

Figure 4:
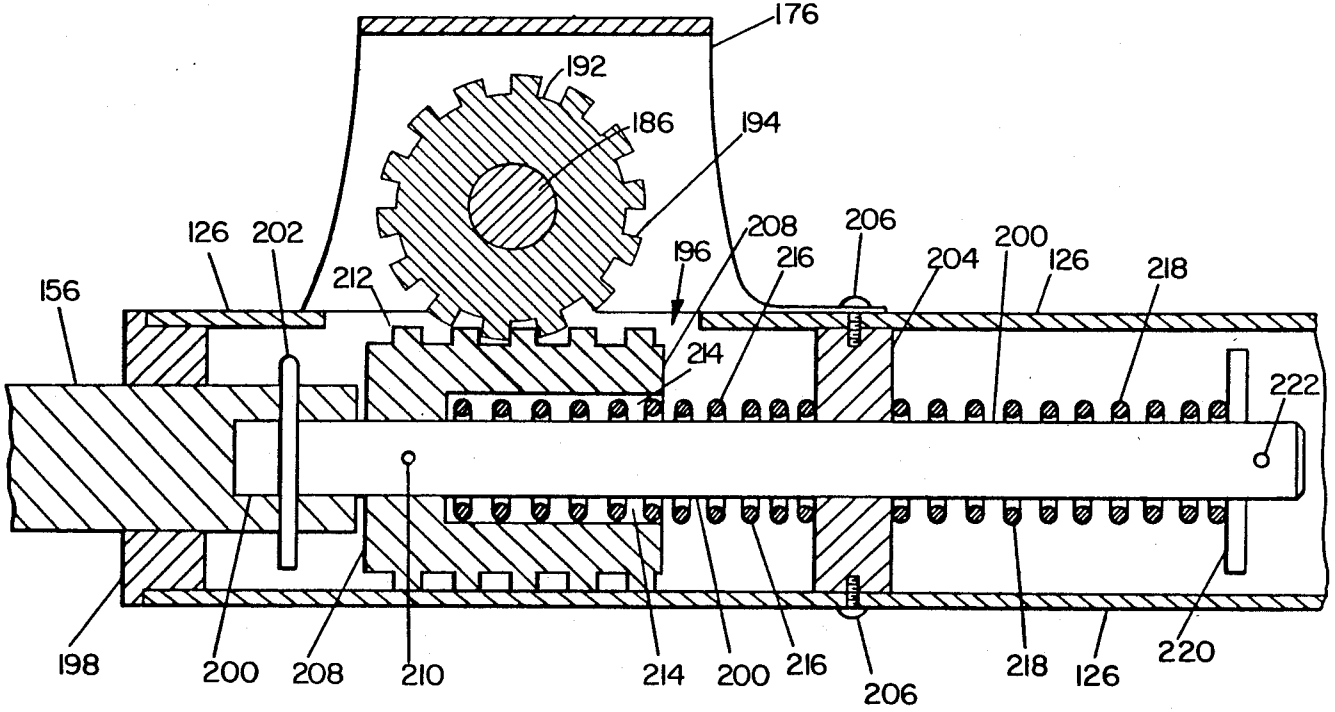
FIG. 4 is a sectional view of the multi-purpose exercising apparatus showing the force measuring mechanism taken along lines 4—4 of FIG. 3.

The gear shaft 186 extends downwardly relative to the position of outer tube 126 depicted in FIG. 3. Rigidly mounted to shaft 186 at its lower end is a pinion gear 192 having a series of gear teeth 194. As shown in FIG. 4, the pinion gear teeth 194 extend into a slot 196 located in the radial surface of outer tube 126.

As also shown in FIG. 4, a stop and guide block 198 is mounted in the end of outer tube 126 adjacent the handle 150. The handle rod 156 extends inwardly from the handle 150 into the outer tube 126 through the guide block 198. The end of handle rod 156 extending into outer tube 126 includes a recessed area conforming to the shape of a slide rod 200. One end of the slide rod 200 is rigidly secured to the handle rod 156 by means of a cotter pin 202 or other suitable connecting means. The slide rod 200 extends at least partially along the axial length of outer tube 126, is centrally positioned therein, and supported by means of a stationary guide block 204 rigidly secured to the outer tube 126 through screws 206.

Located within the outer tube 126, and intermediate the guide block 204 and the end of slide rod 200 received within handle rod 156, is a spring cup 208 as also depicted in FIG. 4. The spring cup 208 includes a cylindrical aperture in which the slide rod 200 is axially received. Slide rod 200 is secured in a stationary position relative to spring cup 208 by means of a pin 210 or similar connecting means.

The spring cup 208 can be substantially cylindrical in shape and includes rack teeth 212. The rack teeth 212 are positioned within the outer tube 126 adjacent the slot 196, and the pinion gear teeth 194 are positioned so as to engage the rack teeth 212.

As further shown in FIG. 4, the spring cup 208 includes a centrally located slot 214 open at one end and extending partially through the axial length of the spring cup 208. Mounted within the slot 214 and extending outwardly around the slide rod 200 to the guide block 204 is a compression spring 216. Bearing against the opposing surface of the guide block 204 from the compression spring 216 is a second compression spring 218. Compression spring 218 is also positioned around the radial surface of slide rod 200, and supported at opposing ends by the guide block 204 and a washer 220 fixed in stationary position relative to the slide rod 200 by means of a roll pin 222 or similar securing means.

In operation, as the outer tube 126 is moved relative to the power slide 132, the outer tube 126 will move axially with respect to slide rod 200 in direct proportion to the frictional force between the sleeve 134 and the outer tube 126. Movement of the outer tube 126 relative to the slide rod 200 and spring cup 208 will cause rotational movement of the pinion gear 192 through engagement of the pinion gear teeth 194 with the rack teeth 212. Rotation of pinion gear 192 will cause corresponding rotation of dial pointer 184 coupled through gear shaft 186 as previously described. The resistance of the movement of the outer tube 126 relative to the slide rod 200 is directly proportional to the frictional force of the power slide 132 on the outer tube 126. As the slide rod 200 moves to the right relative to outer tube 126 as viewed in FIG. 4, the compression spring 216 will be increasingly compressed, thereby requiring increasing forces to continue movement of the spring cup 208 and slide rod 200 relative to the tube 126. Similarly, as the slide rod 200 is moved to the left as viewed in FIG. 4 relative to tube 126, the second compression spring 218 will be compressed, thereby requiring increasing forces to provide further movement. Thus, the movement of the dial pointer 184 is directly proportional to the frictional force between the sleeve 134 and the outer tube 126.

Figure 5:
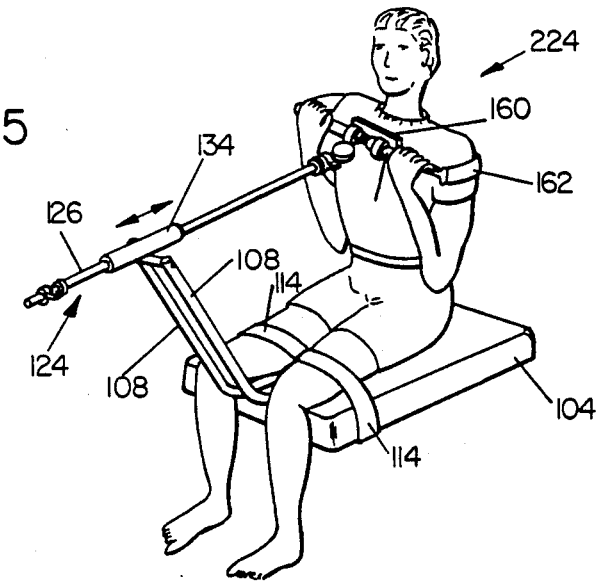
FIG. 5 depicts use of the multi-purpose exercising apparatus shown in FIG. 1, with the patient in a seated upright position so as to exercise muscles/skeletal groups in the back and abdomen regions.

An exemplary exercise performed by a patient 224 with the multi-purpose exercising apparatus 100 is depicted in FIG. 5. It should be noted that the magnitude of resistance required to move the tube 126 with respect to the sleeve 134 can be decreased by providing lubrication on the tube 126 through the lubrication rings 130. Similarly, resistance can be increased by removing lubrication from the outer surface of 126, and variable resistance can be provided over a particular range of motion by selectively lubricating or removing lubrication from various portions of tube 126. It should also be noted that the adjustable control rings 128 provide a means for limiting the range of motion of tube 126 relative to sleeve 134. In addition, moving the control rings 128 inward so that motion of the tube 126 is blocked will allow isometric exercise and also isometric testing of muscle strength of the user.

Referring specifically to FIG. 5, the multipurpose exercising apparatus 100 is utilized to provide various types of exercises involving the muscle/skeletal groups of the back and abdomen regions. As shown in FIG. 5, the patient 224 maintains a seated upright position on the cushion 104 with the patient's legs secured within the leg straps 114 and extending downwardly with the knees bent at approximately a 90° angle.

The patient 224 then secures himself or herself within the apparatus 100 by strapping the back supporting strap 162 around the patient's back and securing the supporting strap to the handle 150 by means of the hook locks 166. The patient 224 can then exert pushing forces against the support block 160 adjacent the patient's sternum region so as to move the outer tube 126 forward relative to the sleeve 134. Correspondingly, the patient 224 can also exert pulling forces on the outer tube 126 by pushing backwards against the back supporting strap 162, thereby moving the outer tube 126 rearward relative to the sleeve 134. Thus, the outer tube 126 is reciprocally moved through the sleeve 134 by a rotational movement of the user's upper body with respect to his or her seat.

Figure 6:
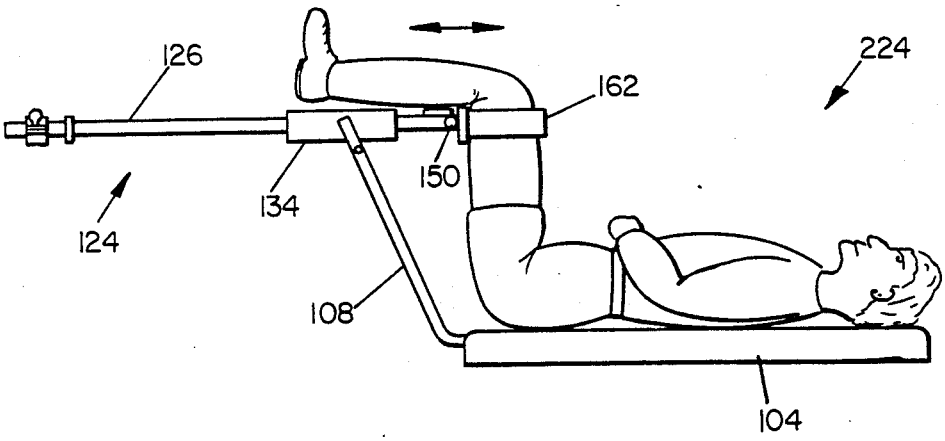
FIG. 6 depicts use of the multi-purpose exercising apparatus shown in FIG. 1 with the patient in a supine position, so as to exercise muscle/skeletal groups in the back and abdomen regions while limiting weight loading on the spine which would occur if the patient were in the seated upright position.

Another exemplary exercise which can be performed by a patient 224 using the multi-purpose exercising apparatus 100 is depicted in FIG. 6. As shown therein, the patient 224 maintains a supine position on the cushion 104. The patient's upper leg regions are bent vertically upward at a 90° angle, and the knees are then bent forwardly at approximately a 90° angle. In this position, the patient's legs are secured within the supporting strap 162 adjacent the knee region.

The under portion of the patient's legs adjacent the upper knee region are then positioned against the support block 160 or the handle 150. The patient 224 can then exert pushing forces so as to move the outer tube 126 forward relative to the sleeve 134. Correspondingly, the patient 224 can also exert pulling forces on the outer tube 126 by pulling backwards against the supporting strap 162, thereby moving the outer tube 126 rearward relative to the sleeve 134. Thus, the outer tube 126 is reciprocably moved through the sleeve 134 by a rotational movement of the user's upper leg region with respect to his or her seat.

The aforedescribed exercise will involve the various muscle/skeletal groups of the back and abdomen, and can also strengthen muscles in the upper leg. In addition, however, although the exercise position shown in FIG. 5 for exercising back and abdomen muscle groups can be used by many patients, it can be substantially important for someone with a spinal injury or similar injury to avoid any weight loading on the spine. Such weight loading would occur if the patient 224 were in the seated upright position as shown in FIG. 5. However, with the patient 224 in the supine position as shown in FIG. 6, muscle groups in the back and abdomen can be exercised without requiring weight loading on the spine.

Figure 7:
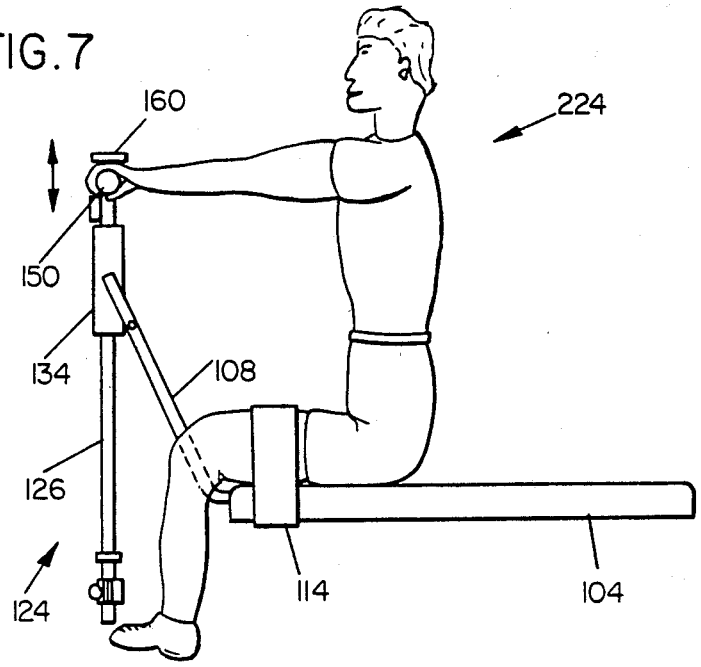
FIG. 7 depicts use of the multi-purpose exercising apparatus shown in FIG. 1, with the patient in a seated upright position, so as to exercise muscle/skeletal groups in the shoulder region.

Another exemplary exercise which can be performed by a patient 224 with the multi-purpose exercising apparatus 100 is depicted in FIG. 7. As shown therein, the patient 224 maintains a seated upright position on the cushion 104 with the patient's legs secured within the leg straps 114 and extending downwardly with the knees bent at approximately a 90° angle. However, unlike the exercise depicted in FIG. 5, the patient 224 as shown in FIG. 7 maintains a position with his or her arms extended outwardly in a straight configuration. With this configuration, the supporting strap 162 is not used and the bar mechanism 124 is maintained in a vertical configuration. The patient 224 can then exert downward forces through the handle 150 so as to move the outer tube 126 downward relative to the sleeve 134. Correspondingly, the patient 224 can also exert upward forces on the outer tube 126 by pulling upwardly on the handle 150, thereby moving the outer tube 126 upward relative to the sleeve 134. Accordingly, the outer tube 126 is reciprocably moved through the sleeve 134 by a rotational movement of the user's arms relative to the shoulder region. This type of exercise will strengthen various muscle/skeletal groups in the arm, shoulder and abdomen regions.

Figure 8:
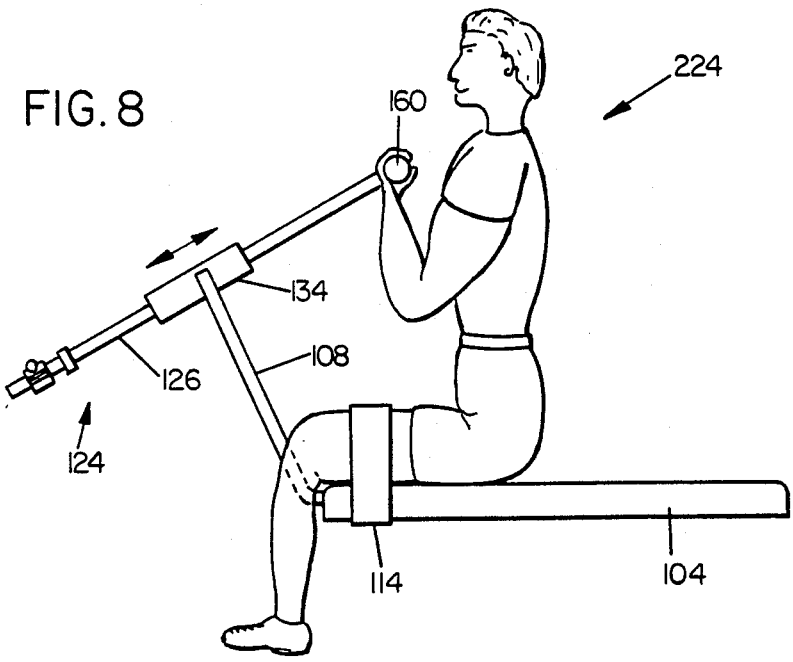
FIG. 8 depicts use of the multi-purpose exercising apparatus shown in FIG. 1, with the patient in a seated upright position, and with the bar mechanism angled in a manner so that the patient will exercise bicep and tricep muscle groups in the arm region.

Still another exemplary exercise employing the multi-purpose exercising apparatus 100 is shown in FIG. 8. Again, the patient 224 maintains a seated upright position on the cushion 104, with the patient's legs secured within the leg straps 114 and extending downwardly with the knees bent at approximately a 90° angle.

As with the exercise depicted in FIG. 7, the patient 224 as shown in FIG. 8 does not employ the supporting strap 162. Instead, the patient 224 will grip the handle 150 through the handgrips 152 with the arms bent at the elbow regions at a desired angle. The patient 224 can grip the handle 150 with the palms of the patient's hands in either a forward or rearward direction. As shown in FIG. 8, the patient's hands grip the handle 150 so that the palms are facing rearward.

The patient 224 can then exert pushing or pulling forces on the outer tube 126 by exerting forces thereon through the handle 150. With the multi-purpose exercising apparatus used in this manner, muscle groups such as the biceps and triceps of the arm regions can be strengthened.

The afore-described types of movement and other exercising movements can provide a variety of different types of exercises for the patient's shoulder, arm, back, abdomen and leg regions. It should be noted that the pivotable coupling of the cross bar 120 to the tubular bars 108 provides a means for adjustment of the position and angle of exercise bar mechanism 124 relative to the cushion 104, so as to provide a variety of exercises for different areas of the patient's shoulder, arm, abdomen, back and leg regions, in addition to accommodating patients of different sizes.

The principles of the invention are not limited to the specific multi-purpose exercising apparatus 100 as described herein. For example, the positioning of the force measuring mechanism 170 can be moved to various locations relative to the elongated tube 126. In addition, various other types of structural interconnections can be utilized between the cushion 104, elongated bars 108 and exercise bar mechanism 124, while still providing for different types of rehabilitative exercises for various muscle/skeletal groups in the shoulder, arm, abdomen and back regions in accordance with the invention. Further, structural configurations other than the particular configuration of the force measuring mechanism 170 described herein can be employed to provide a force measuring means. It will be apparent to those skilled in the art that modifications and other variations of the above-described illustrative emodiment of the invention may be effected without departing from the spirit and scope of the novel concepts of the invention.

The embodiments of the invention in which an exclusive property or privilege is claimed are defined as follows:

1. A multi-purpose exercise apparatus comprising:

a portable structural frame for providing a fixed base support while the exercise apparatus is in use, and having body-positioning means to position one portion of a user's body;

an exercise bar assembly comprising a sleeve member, an elongated tube slidably received throught said sleeve member, and means Providing frictional resistance to movement of said elongated tube through said sleeve member;

means for mounting said exercise bar assembly to said structural frame;

an elongated reactive member axially movable with respect to said elongated tube, and at least partially received within one end of said tube;

force measuring means mounted to said elongated tube for visually indicating to said user the relative magnitude of force applied between said sleeve member and said elongated tube;

force applying means coupled to said reactive member adapted to be selectively positioned relative to said user so as to bear against said user's upper frontal region, back or upper legs, or to be releasably gripped by said user's hands for exerting axially-directed forces on said elongated tube relative to said sleeve member in response to forces exerted by said user; and said force-measuring means comprises means for coupling said elongated reactive member to said elongated tube so that the displacement of said tube relative to said reactive member is proportional to the magnitude of force applied to said exercise bar assembly by said user.

2. A multi-purpose exercise apparatus in accordance with claim 1 wherein said force applying means comprises releasably secured strap means so that said user, while maintaining a seated upright position on said body-positioning means, can move said elongated tube through said sleeve member by exerting forces against said strap means through his or her back.

3. A multi-purpose exercise apparatus in accordance with claim 1 wherein said force applying means comprises releasably secured strap means so that said user, while maintaining a supine position on said body-positioning means, can move said elongated tube through said sleeve member by exerting forces against said strap means through his or her upper leg regions adjacent his or her knee regions.

4. A multi-purpose exercise apparatus in accordance with claim 1 wherein said force applying means comprises a flat surface adjacent one end of said elongated tube and located in a perpendicular plane relative to said tube so that said user, while maintaining a seated upright position on said body-positioning means, can move said elongated tube through said sleeve member by pushing against said surface with his or her sternum region.

5. A multi-purpose exercise apparatus in accordance with claim 1 wherein said mounting means comprises means for pivotably mounting said exercise bar assembly to said frame.

6. A multi-purpose exercise apparatus in accordance with claim 5 wherein said means for pivotably mounting said exercise bar assembly to said frame provides for positioning of said exercise bar assembly so that said user, while maintaining a seated upright position on said body-positioning means, can position said exercise bar assembly in a vertical orientation and move said elongated tube through said sleeve member by exerting forces on said force applying means in a manner so as to exercise muscle groups in said user's shoulder regions.

7. A multi-purpose exercise apparatus in accordance with claim 5 wherein said means for pivotably mounting said exercise bar assembly to said frame provides for said exercise bar assembly to be angled relative to said frame so that said user, while maintaining a seated upright position on said body-positioning means, can releasably grip said force applying means so as to move said elongated tube through said sleeve member by exerting forces against said force applying means in a manner so as to exercise bicep and tricep muscle groups in said user's arm regions.

8. A multi-purpose exercise apparatus in accordance with claim 1 wherein said mounting means comprises:

a pair of elongated bars rigidly secured to said structural frame and extending at an angle upwardly and forwardly from said frame; and pivot means coupled to said elongated bars and said sleeve member for pivotably mounting said sleeve member relative to said structural frame.

9. A multi-purpose exercise apparatus in accordance with claim 1 wherein said body-positioning means comprises a cushion on which said user may sit.

10. A multi-purpose exercise apparatus in accordance with claim 1 wherein said force applying means is coupled to one end of said elongated tube, and said force measuring means is mounted on said tube adjacent said one end.

11. A multi-purpose exercise apparatus in accordance with claim 1 wherein said force measuring means comprises a dial face mounted on said elongated tube and visible to said user, and a pointer rotatably mounted on said dial face to visually indicate forces applied to said elongated tube relative to said sleeve member.

12. A multi-purpose exercise apparatus in accordance with claim 1 and further comprising means to adjustably limit the movement of said elongated tube through said sleeve member.

13. A multi-purpose exercise apparatus in accordance with claim 12 wherein said movement limiting means comprises:

a pair of rings slidably mounted on said elongated tube, one of said rings positioned on each side of said sleeve member; and means coupled to each of said rings for securing each of said rings in an adjusted position on said elongated tube, whereby said sleeve member can be limited to movement along the entire length of said tube down to no movement at selected positions along the length of said tube.

14. A multi-purpose exercise apparatus in accordance with claim 1 wherein:

said body-positioning means comprises a cushion on which said user may sit;

said mounting means comprises a pair of elongated bars rigidly mounted to said structural frame and extending upwardly and forwardly therefrom, and means coupled to said sleeve member and said elongated bars for pivotably mounting said exercise bar assembly relative to said structural frame;

said force applying means comprises a hand-bar perpendicularly coupled to one end of said elongated tube, a rectangular support block mounted to said hand-bar so as to be perpendicular to an axis of the elongated tube, and a strap releasably coupled to ends of the hand-bar; and said exercise apparatus further comprises means to adjustably limit the movement of said elongated tube through said sleeve member.

15. A multi-purpose exercise apparatus comprising:

a portable structural frame having a base for providing a fixed base support while the exercise apparatus is in use and sleeve support means extended upwardly and forwardly of said base;

body-positioning means on said base support providing a seat on which the user can sit;

an exercise bar assembly comprising a sleeve member, an elongated tube slidably received through said sleeve member, and means providing frictional resistance to movement of said elongated tube through said sleeve member;

an elongated reactive member axially movable with respect to said elongated tube, and at least partially received within one end of said tube;

means for pivotably mounting said sleeve member to said sleeve support means;

force applying means coupled to said reactive member so that said elongated tube can be moved reciprocably through said sleeve member by movement of a user's body in engagement with said force applying means; and means for coupling said elongated reactive member to said elongated tube so that displacement of said tube relative to said reactive member is proportional to the magnitude of force applied to said exercise bar assembly by said user.

16. A multi-purpose exercise apparatus in accordance with claim 15 wherein said force applying means comprises handgrips which extend laterally of said elongated tube so that the user can grasp the handgrips with his or her hands.

17. A multi-purpose exercise apparatus in accordance with claim 15 wherein said force applying means comprises a strap which is adapted to be releasably secured around the chest of a user for movement of the elongated tube by reciprocal rotational movement of the user's upper body with respect to the seat thereof.

* * * * *